US009243597B2

(12) United States Patent
Egashira et al.

(10) Patent No.: US 9,243,597 B2
(45) Date of Patent: Jan. 26, 2016

(54) FUEL INJECTION PUMP

(75) Inventors: Takanori Egashira, Osaka (JP); Kazutaka Sone, Osaka (JP); Shinya Umeda, Osaka (JP); Stefan Kiechle, Aken (DE)

(73) Assignees: Yanmar Co., Ltd., Osaka (JP); Woodward, Inc., Fort Collins, CO (US)

( * ) Notice: Subject to any disclaimer, the term of this patent is extended or adjusted under 35 U.S.C. 154(b) by 672 days.

(21) Appl. No.: 13/581,099

(22) PCT Filed: Feb. 22, 2011

(86) PCT No.: PCT/JP2011/053853

§ 371 (c)(1), (2), (4) Date: Aug. 24, 2012

(87) PCT Pub. No.: WO2011/105375

PCT Pub. Date: Sep. 1, 2011

(65) Prior Publication Data

US 2012/0321496 A1 Dec. 20, 2012

(30) Foreign Application Priority Data

Feb. 26, 2010 (JP) ..... 2010-042621

(51) Int. Cl.

*F04B 53/10* (2006.01)
*F04B 7/00* (2006.01)
*F02M 59/46* (2006.01)

(Continued)

(52) U.S. Cl.

CPC ..... *F02M 59/466* (2013.01); *F02M 59/366* (2013.01); *F02M 59/462* (2013.01); *F02M 63/0033* (2013.01); *F02M 63/0077* (2013.01); *F02M 59/102* (2013.01);

(Continued)

(58) Field of Classification Search

CPC ..... F02M 59/366; F02M 59/466; F02M 63/0033; F02M 63/0077; F02M 59/462; F02M 2200/04; F02M 2200/315; F02M 2200/02

USPC ..... 417/298, 470, 505, 506; 251/129.15, 251/129.16, 129.02; 123/446, 447, 506

See application file for complete search history.

(56) References Cited

U.S. PATENT DOCUMENTS 5,441,029 A * 8/1995 Hlousek ..... 123/467
6,059,545 A * 5/2000 Straub et al. ..... 417/505

(Continued)

FOREIGN PATENT DOCUMENTS

CZ 19963926 7/2001
GB 2 335 007 A 9/1999

(Continued)

OTHER PUBLICATIONS

Office Action for corresponding Japanese Appl. 2013-0580466, "Notice of Reasons for Refusal," shipping date: Jan. 7, 2014, 4 pages.

(Continued)

*Primary Examiner* — Peter J Bertheaud
*Assistant Examiner* — Dominick L Plakkoottam
(74) *Attorney, Agent, or Firm* — Sterne, Kessler, Goldstein & Fox P.L.L.C.

(57) ABSTRACT

A fuel injection pump is provided which can be manufactured without an increase in the manufacturing cost and which is configured so that the sealing performance of an electromagnetic spill valve can be maintained with minimum maintenance cost.

3 Claims, 9 Drawing Sheets

(51) Int. Cl.
*F02M 59/36* (2006.01)
*F02M 63/00* (2006.01)
*F02M 59/10* (2006.01)

(52) U.S. Cl.
CPC ..... *F02M 2200/02* (2013.01); *F02M 2200/04* (2013.01); *F02M 2200/315* (2013.01)

(56) References Cited

U.S. PATENT DOCUMENTS

| | | | | |
|---|---|---|---|---|
| 6,729,553 | B1 * | 5/2004 | Hlousek | 239/88 |
| 2002/0073966 | A1 * | 6/2002 | Rodriguez-Amaya | 123/446 |

FOREIGN PATENT DOCUMENTS

| | | |
|---|---|---|
| GB | 2 356 675 A | 5/2001 |
| JP | 09-119546 | 5/1997 |
| JP | 09-119550 | 5/1997 |
| JP | H10153157 | 6/1998 |
| JP | 2006-112598 | 4/2006 |
| JP | 2006-307829 | 11/2006 |
| JP | 2007-120463 | 5/2007 |
| JP | 2011179355 | 9/2011 |

OTHER PUBLICATIONS

International Search Report for International Application No. PCT/JP2011/053853, Japanese Patent Office, mailed Apr. 12, 2011, 4 pages.

Supplementary European Search Report based on Application No. 11747336 dated Aug. 12, 2013, 6 pages.

* cited by examiner (a)

(b)

(a)

(b)

(a)

(b)

FUEL INJECTION PUMP

TECHNICAL FIELD

The present invention relates to a fuel injection pump mounted on a diesel engine.

BACKGROUND ART

Conventionally, a fuel injection pump mounted on a large diesel engine is known in which timing and number of times of fuel injection is controlled corresponding to the driving state of the engine for improving fuel efficiency and reducing exhaust gas emission. In such a fuel injection pump, an electromagnetic spill valve is opened and closed at optional timing so as to perform accurate fuel injection.

In the electromagnetic spill valve, a spill valve body is opened and closed complicatedly and quickly corresponding to the driving state of the engine, whereby large impact and rubbing occur continuously. As a result, abrasion occurs in a seal surface and a valve seat, whereby the seal surface cannot sit closely on the valve seat and fuel leaks. Accordingly, for improving abrasion resistance of the seal surface and the valve seat, it is necessary to construct the spill valve body and the whole housing with material having high strength, whereby the manufacturing cost is increased.

Then, the art has been proposed in which material (surface) constructing one of a spill valve body (valve object) in which a seal surface (seat part) is formed and a housing (valve body) in which a valve seat (valve seat part) is formed is softer than material constructing the other thereof. According to this art, when abrasion occurs in the seal surface (seat part) or the valve seat (valve seat part), the one of the surfaces formed the softer material follows the shape of the other surface, whereby the seat part touches closely to the valve seat part and the leakage of fuel is reduced. The art shown in the Patent Literature 1 is an example of the above-mentioned art.

However, in such an art as shown in the Patent Literature 1, when the abrasion in the seat part and the valve seat part is advanced and the effect of reduction of fuel leakage by the softer material cannot be obtained, the whole electromagnetic spill valve must be exchanged for maintain the sealing characteristic of the electromagnetic spill valve. Namely, there is a problem in that construction members of the electromagnetic spill valve which do not need to be exchanged are exchanged simultaneously, whereby the maintenance cost which is not necessary essentially is caused.

PRIOR ART REFERENCE

Patent Literature

Patent Literature 1: the Japanese Patent Laid Open Gazette 2006-112598

DISCLOSURE OF INVENTION

Problems to Be Solved by the Invention

The present invention is provided in consideration of the above problems, and the purpose of the present invention is to provide a fuel injection pump in which the sealing performance of an electromagnetic spill valve can be maintained with minimum maintenance cost without increasing manufacturing cost.

Means for Solving the Problems

According to the present invention, a fuel injection pump having an electromagnetic spill valve, wherein the electromagnetic spill valve comprises a housing in which an insert piece insertion hole is formed, an insert piece formed to be substantially a cylinder whose inner peripheral surface has a valve seat and detachably installed in the insert piece insertion hole coaxially, a spill valve body formed to be substantially a cylinder whose outer peripheral surface has a seal surface facing the valve seat and slidably inserted into the insert piece so that the seal surface can sit on the valve seat when the spill valve body is slid toward one of sides in the axial direction of the insert piece, a stopper which is attached detachably to the insert piece insertion hole and can touch the spill valve body when the spill valve body is slid toward the other side in the axial direction of the insert piece, a solenoid which can make the spill valve body slid toward the one side in the axial direction, and a biasing member biasing the spill valve body toward the other side in the axial direction.

According to the present invention, in the electromagnetic spill valve, the end at the other side of the insert piece touches the stopper, and the end at the one side of the spill valve body is separated from the stopper when the seal surface sits on the valve seat.

According to the present invention, in the electromagnetic spill valve, the spill valve body is supported by only the insert piece.

According to the present invention, in the electromagnetic spill valve, a shim is interposed between the end at the other side of the insert piece and the stopper so as to be exchangeable.

Effect of the Invention

The present invention constructed as the above brings the following effects.

According to the present invention, in the fuel injection pump, when the valve seat of the electromagnetic spill valve is worn with the passage of time, what is necessary is just to exchange the spill valve body and the insert piece having the valve seat. Namely, the components which need not be exchanged can be used continuously. Accordingly, the whole housing of the electromagnetic spill valve need not be constructed by material with high strength. In the electromagnetic spill valve, the insert piece can be shaped simply so as to form the valve seat in the insert piece easily and accurately. As a result, when number of the parts increased, the characteristics of the fuel injection pump can be maintained with the minimum maintenance cost without increasing the manufacturing cost.

Furthermore, according to the present invention, at the time of opening the electromagnetic spill valve, the spill valve body can be slid toward the other side in the axial direction of the insert piece until the end at the other side of the spill valve body reaches the position the same as the end at the other side of the insert piece. Namely, the lift amount of the spill valve body at the time of opening the electro-magnetic spill valve is equal to the distance between the end at the other side of the spill valve body and the end at the other side of the insert piece in the axial direction in the state in which the seal surface of the spill valve body has sit on the valve seat of the insert piece, that is, at the time of opening the electromagnetic spill valve. Accordingly, in the electromagnetic spill valve, by only changing the positional relation between the end at the other side of the spill valve body and the end at the other side of the insert piece, the lift amount of the spill valve body can be controlled. As a result, the lift amount of the spill valve body can be controlled easily and accurately, whereby the manufacturing cost and the maintenance cost can be reduced.

Furthermore, according to the present invention, the spill valve body is guided by only the insert piece. Accordingly, in the electromagnetic spill valve, the spill valve body can be installed accurately. As a result, the sitting accuracy of the valve seat of the insert piece and the seal surface of the spill valve body can be improved so as to suppress the amount of abrasion, whereby the maintenance cost can be reduced.

Furthermore, according to the present invention, in the electromagnetic spill valve, the lift amount of the spill valve body can be controlled by only changing the position of the touching surface of the stopper by exchanging the shim. Accordingly, it is not necessary to have the plurality of the stopper having different positions of the touching surface as stock parts for the control. As a result, the cost of the stock parts for the control can be reduced, and the lift amount of the spill valve body can be controlled easily and accurately, whereby the manufacturing cost and the maintenance cost can be reduced.

DESCRIPTION OF NOTATIONS

Figure 1:
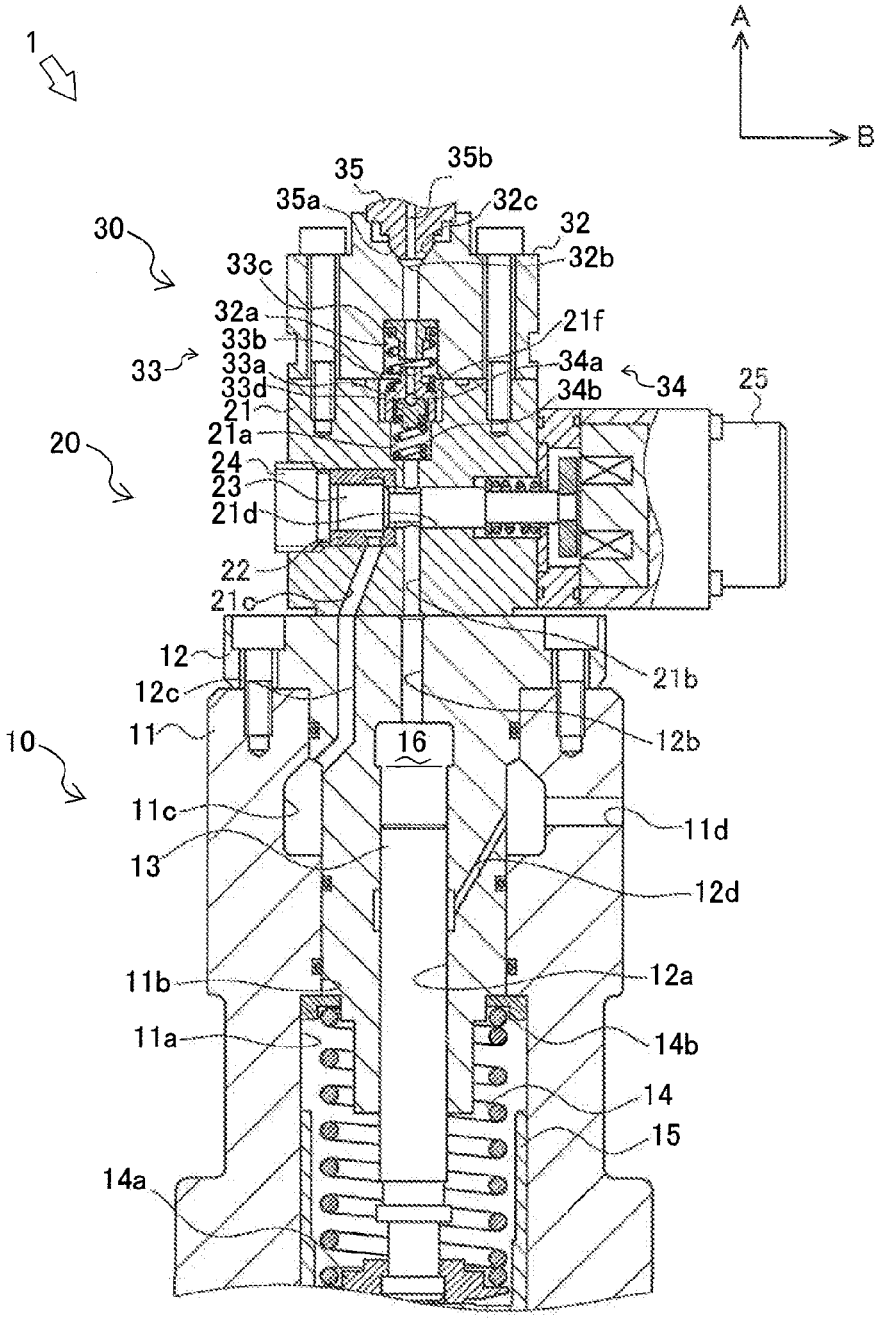
[FIG. 1] A sectional view of a part of a fuel injection pump according to a first embodiment of the present invention.

1 fuel injection pump
20 electromagnetic spill valve
21 housing
21*e* insert piece insertion hole
22 insert piece
22*b* valve seat
23 spill valve body
23*b* seal surface
24 stopper
24*a* touching surface
25 solenoid

DETAILED DESCRIPTION OF THE INVENTION

Next, an explanation will be given on a fuel injection pump 1 which is a fuel injection pump according to a first embodiment of the present invention referring to FIGS. 1 and 2. Hereinafter, a direction of an arrow A is regarded as the upward direction so as to prescribe the vertical direction, and a direction of an arrow B is regarded as the rightward direction so as to prescribe the lateral direction.

As shown in FIG. 1, the fuel injection pump 1 is connected to a low-pressure pump (feed pump), not shown, and compresses fuel from the low-pressure pump and supplies it to a fuel injection nozzle (not shown). The fuel injection pump 1 has a pump body part 10, an electromagnetic spill valve 20 and a two-way delivery valve part 30.

The pump body part 10 includes a pump body 11, a barrel 12, a plunger 13, a plunger spring 14, a tappet 15, a cam (not shown) and the like.

The pump body 11 is substantially cylindrical. In the axis part of the lower end surface of the pump body 11, a plunger spring chamber 11*a* in which the plunger spring 14, the tappet 15 and the like are installed is formed while the lower side of the plunger spring chamber 11*a* is opened. In the axis part of the upper end surface of the pump body 11, a barrel holding hole 11*b* holding the barrel 12 is formed while the upper side of the barrel holding hole 11*b* is opened. The barrel holding hole 11*b* is communicated with the plunger spring chamber 11*a* in the pump body 11. In the vertical middle portion of the barrel holding hole 11*b* of the pump body 11, a circular diameter enlarged part is formed. The diameter enlarged part constitutes an outer side surface of a fuel supply and discharge chamber 11*c*. A fuel supply port 11*d* is formed in the outer side surface of the pump body 11 so as to be communicated with the fuel supply and discharge chamber 11*c*. The fuel supply port 11*d* is connected to a low-pressure pump (not shown).

In the barrel 12, the plunger 13 is installed slidably axially, that is, vertically. The barrel 12 is formed substantially cylindrically and inserted closely into the barrel holding hole 11*b* of the pump body 11 so that the upper and lower ends of the barrel 12 are projected upward and downward from the barrel holding hole 11*b*. In the axis part of the barrel 12, a plunger hole 12*a* in which the plunger 13 is installed is formed while the lower end of the plunger hole 12*a* is opened. In the barrel 12 and above the plunger hole 12*a* a first fuel supply passage 12*b* is formed so as to be extended vertically. The first fuel supply passage 12*b* is communicated with the plunger hole 12*a*. At the upper end of the barrel 12, a flange is formed so as to be projected axially. The barrel 12 is fixed to the upper end of the pump body 11 by a bolt or the like via the flange while the barrel 12 is inserted into the barrel holding hole 11*b*. Accordingly, the circular diameter enlarged part of the barrel holding hole 11*b* and the outer peripheral surface of the barrel 12 constitute the fuel supply and discharge chamber 11*c*. At the part outward from the first fuel supply passage 12*b* of the barrel 12 in the radial direction, a first spill oil discharge passage 12*c* is formed so as to be extended substantially vertically. The first spill oil discharge passage 12*c* is communicated with the fuel supply and discharge chamber 11*c* of the pump body 11.

The plunger 13 compresses fuel. The plunger 13 is formed substantially cylindrically and inserted closely into the plunger hole 12*a*. The upper end surface of the plunger 13 and the plunger hole 12*a* constitute a pressure chamber 16.

The plunger spring 14 is a compression spring and biases the plunger 13 downward. The plunger spring 14 is engaged with the outer side of the lower portion of the plunger 13 while the direction of expansion and contraction of the plunger spring 14 is along the vertical direction. The lower end of the plunger spring 14 is hung on the plunger 13 via a plunger spring receiver 14*a*, and the upper end of the plunger spring 14 is hung on the pump body 11 via a plunger spring receiver 14*b*.

The tappet 15 transmits the pressing power from a cam (not shown) to the plunger 13. The tappet 15 is formed to be a cylinder having a bottom and inserted closely into the plunger spring chamber 11*a* so as to be slidable vertically. In the tappet 15, the lower portion of the plunger 13, the plunger spring 14 and the plunger spring receiver 14*a* are installed. At the bottom of the tappet 15, a roller (not shown) is rotatably supported so as to face to the cam arranged below. The tappet 15 touches to the cam via the roller by the biasing force of the plunger spring 14. The tappet 15 receives the pressing power from the cam via the roller and transmits the messing power to the plunger 13. Accordingly, the plunger 13 is slid vertically following the rotation of the cam.

The electromagnetic spill valve 20 controls fuel injection amount and injection timing of the fuel injection pump 1. The electromagnetic spill valve 20 has a housing 21, an insert piece 22, a spill valve body 23, a stopper 24, a solenoid 25 and the like.

The housing 21 is a structure constituting the body of the electromagnetic spill valve 20. The housing 21 is substantially rectangular. In the upper portion of the housing 21, a two-way delivery valve spring chamber 21*a* is formed so as to be extended vertically. A delivery valve chamber 21*f* is formed so as to be enlarged its diameter and extended upward from the middle portion of the two-way delivery valve spring chamber 21*a*. In the lower portion of the housing 21, a second fuel supply passage 21*b* is formed so as to be extended vertically. The two-way delivery valve spring chamber 21*a* is communicated with the second fuel supply passage 21*b*. In the middle portion in the vertical direction of the housing 21, a spill valve hole 21*d* is formed so as to penetrate the housing 21 laterally. The spill valve hole 21*d* crosses and is communicated with the second fuel supply passage 21*b*. Accordingly, the spill valve hole 21*d* is communicated with the two-way delivery valve spring chamber 21*a* via the second fuel supply passage 21*b*. A female screw part is formed at the left end of the spill valve hole 21*d* and a diameter enlarged part in which a spill valve spring 23*e* is installed is formed at the right end of the spill valve hole 21*d*.

Figure 2:
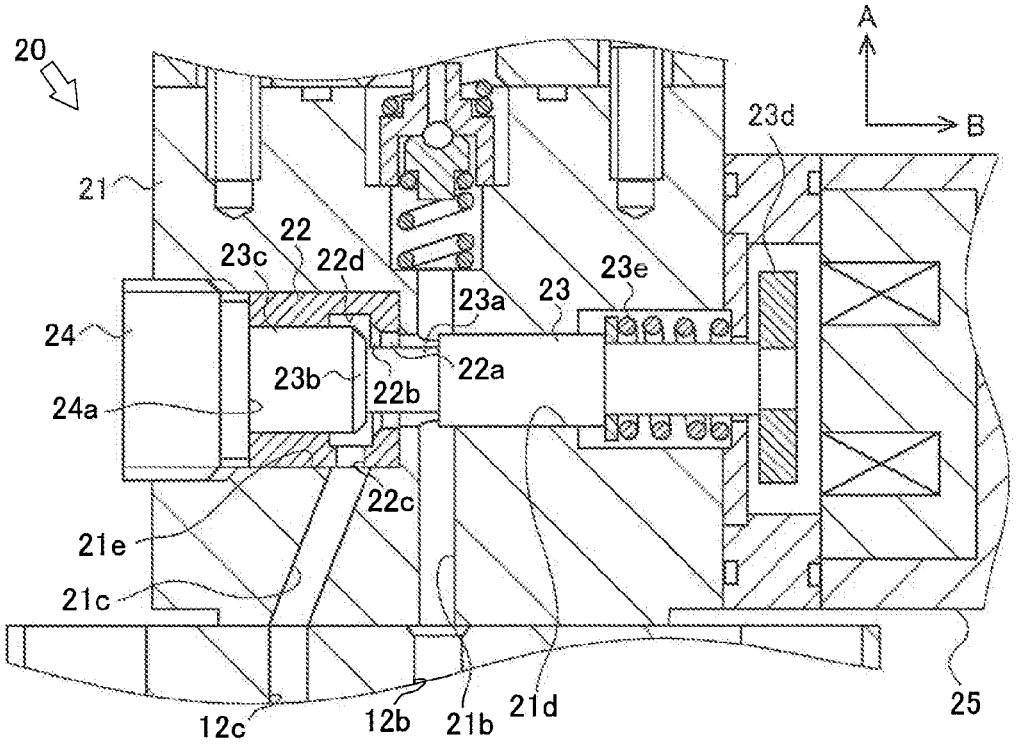
[FIG. 2] An enlarged sectional view of an electromagnetic spill valve of the fuel injection pump shown in FIG. 1.

As shown in FIG. 2, the part of the spill valve hole 21*d* leftward from the communication part with the second fuel supply passage 21*b* is enlarged its diameter to the left end of the spill valve hole 21*d* so as to be formed as an insert piece insertion hole 21*e*. In the part outside the second fuel supply passage 21*b* of the housing 21, a second spill oil discharge passage 21*c* is formed so as to be extended vertically. The second spill oil discharge passage 21*c* is communicated with the insert piece insertion hole 21*e*. The housing 21 is fixed to the barrel 12 by a bolt or the like while the lower end surface of the housing 21 adheres closely to the upper end surface of the barrel 12. In this case, the second fuel supply passage 21*b* is communicated with the first fuel supply passage 12*b* of the barrel 12, and the second spill oil discharge passage 21*c* is communicated with the first spill oil discharge passage 12*c* of the barrel 12.

The insert piece 22 is a member on which the spill valve body 23 sits. The insert piece 22 is formed to be a substantially cylinder whose length is substantially the same as that of the insert piece insertion hole 21*e*. The insert piece 22 is inserted closely and detachably into the insert piece insertion hole 21*e* so that the right end of the insert piece 22 touches a stepped part formed at the right end of the insert piece insertion hole 21*e*. The inner diameter of the left side of the insert piece 22 is larger than the diameter of the spill valve hole 21*d*. At the right end of the insert piece 22, a diameter reduced part 22*a* is formed whose diameter is reduced to the same as the diameter of the spill valve hole 21*d*. At the left end of the diameter reduced part 22*a*, a circular valve seat 22*b* is formed taperingly so that its diameter is enlarged leftward. Furthermore, a diameter enlarged part 22*d* whose inner diameter is enlarged is formed adjacently to the left side of the valve seat 22*b*. A spill oil discharge outlet 22*c* is formed so as to communicate the diameter enlarged part 22*d* with the second spill oil discharge passage 21*c* of the housing 21.

The spill valve body 23 switches the flow path of fuel pressingly sent in the second fuel supply passage 21*b*. The right portion of the spill valve body 23 is slidably inserted into the spill valve hole 21*d*, and the left portion of the spill valve body 23 is inserted into the insert piece 22. In the part of the spill valve body 23 crossing the second fuel supply passage 21*b* of the housing 21 when the spill valve body 23 is inserted into the spill valve hole 21*d*, a diameter reduced part 23*a* whose diameter is smaller than that of the spill valve hole 21*d* is provided. Accordingly, the spill valve body 23 does not block the flow of fuel in the second fuel supply passage 21*b* over the spill valve hole 21*d*. At the left end of the diameter reduced part 23*a*, the spill valve body 23 has a circular seal surface 23*b* formed taperingly so that its diameter is enlarged leftward. The seal surface 23*b* is formed so as to be able to sit closely on the valve seat 22*b* of the insert piece 22.

The spill valve body 23 has a diameter enlarged part 23*c* whose diameter is enlarged the same as the inner diameter of the insert piece 22 from the left end surface of the spill valve body 23 to the seal surface 23*b*. The part of the spill valve body 23 rightward from the diameter reduced part 23*a* is slidably inserted into the spill valve hole 21*d* of the housing 21, and the diameter enlarged part 23*c* at the part leftward from the seal surface 23*b* is slidably inserted into the insert piece 22. Accordingly, when the spill valve body 23 is slid rightward, the seal surface 23*b* sits on the valve seat 22*b* of the insert piece 22. In this case, the left end of the spill valve body 23 is positioned at the right of the left end of the insert piece 22. The spill valve body 23 is biased leftward by the spill valve spring 23*e* installed in the diameter enlarged part at the right end of the spill valve hole 21*d*. At the right end of the spill valve body 23, an armature 23*d* constructed by a magnetic substance is disposed.

The stopper 24 restricts the slide of the spill valve body 23. The stopper 24 has a touching surface 24*a* at the right end surface thereof and is formed to be a substantially cylinder which can be engaged spirally with the insert piece insertion hole 21*e* of the housing 21. The stopper 24 is screwed into the insert piece insertion hole 21*e* of the housing 21 rightward so that the touching surface 24*a* touches the left end surface of the insert piece 22 inserted in the insert piece insertion hole 21*e*. Accordingly, the stopper 24 fixes the insert piece 22 to the inside of the insert piece insertion hole 21*e*. The stopper 24 is constructed so that the left end surface of the spill valve body 23 touches the touching surface 24*a* when the spill valve body 23 is slid leftward. Accordingly, the stopper 24 can restrict the slide amount of the spill valve body 23.

The solenoid 25 generates magnetic force. The solenoid 25 is fixed to the housing 21 so that the adsorption surface of the solenoid 25 faces the right end surface of the housing 21 in which the spill valve hole 21*d* is formed. The solenoid 25 generates magnetic force by receiving a signal from a control device (not shown) so as to absorb the armature 23*d* disposed in the spill valve body 23. Accordingly, the solenoid 25 makes the spill valve body 23 slide rightward based on the signal from the control device (not shown).

Accordingly, in the electromagnetic spill valve 20, when the spill valve body 23 is slid leftward by the spill valve spring 23*e*, the seal surface 23*b* of the spill valve body 23 is separated from the valve seat 22*b* of the insert piece 22. As a result, the second fuel supply passage 21*b* is communicated with the second spill oil discharge passage 21*c* via the spill valve hole 21*d*, the inside of the diameter enlarged part 22*d* of the insert piece 22 and the spill oil discharge outlet 22*c*.

On the other hand, when the spill valve body 23 is slid rightward oppositely to the biasing force of the spill valve spring 23*e* by the solenoid 25, the seal surface 23*b* of the spill valve body 23 sits on the valve seat 22*b* of the insert piece 22. As a result, the communication between the second fuel supply passage 21*b* and the second spill oil discharge passage 21*c* is cut off.

As shown in FIG. 1, the two-way delivery valve part 30 discharges fuel and maintains fuel pressure in a high-pressure pipe joint 35 after fuel injection at a predetermined value. The two-way delivery valve part 30 includes a two-way delivery valve body part 32, a delivery valve 33, a two-way delivery valve 34 and the like. The high-pressure pipe joint 35 is connected to the two-way delivery valve part 30.

The two-way delivery valve body part 32 is a cylinder whose lower end surface is substantially the same as the upper end surface of the housing 21. The two-way delivery valve body part 32 is fixed to the housing 21 by bolts or the like while the lower end surface of the two-way delivery valve body part 32 adheres closely to the upper end surface of the housing 21. In the lower portion of the two-way delivery valve body part 32, a delivery valve spring chamber 32*a* is formed so as to be extended vertically and is arranged oppositely to the delivery valve chamber 21*f*. The delivery valve spring chamber 32*a* is communicated with the two-way delivery valve spring chamber 21*a* and the delivery valve chamber 21*f*. In the inner peripheral surface of the upper portion of the two-way delivery valve body part 32, a circular seal surface 32*c* is formed funnel-like which is reduced its diameter continuously downward so as to be fastened tightly to the high-pressure pipe joint 35. In the vertical middle portion of the upper portion of the two-way delivery valve body part 32, a discharge outlet 32*b* is opened. The delivery valve spring chamber 32*a* and a female screw part 32*d* are communicated via the discharge outlet 32*b*.

The delivery valve 33 discharges fuel from the discharge outlet 32*b*. The delivery valve 33 includes a delivery valve body 33*a* and a delivery valve spring 33*c*. The delivery valve body 33*a* is formed substantially cylindrically and is installed in the delivery valve chamber 21*f* so as to form a space between the delivery valve body 33*a* and the inner peripheral surface of the delivery valve chamber 21*f* through which high-pressure fuel can pass. The delivery valve spring 33*c* is installed above the delivery valve body 33*a* in the delivery valve chamber 21*f*. The delivery valve body 33*a* is biased downward by the delivery valve spring 33*c* so that the lower end surface of the delivery valve body 33*a* sits on the lower end surface of the delivery valve chamber 21*f* In the lower portion of the delivery valve body 33*a*, a recess opened downward is formed. The inside of the recess is regarded as a two-way delivery valve chamber 33*d*. In the upper portion of the delivery valve body 33*a*, a two-way delivery valve passage 33*b* is formed so as to be extended vertically. The lower side of the two-way delivery valve passage 33*b* is communicated with the two-way delivery valve chamber 33*d*, and the upper side of the two-way delivery valve passage 33*b* is communicated with the delivery valve spring chamber 32*a*.

Figure 3:
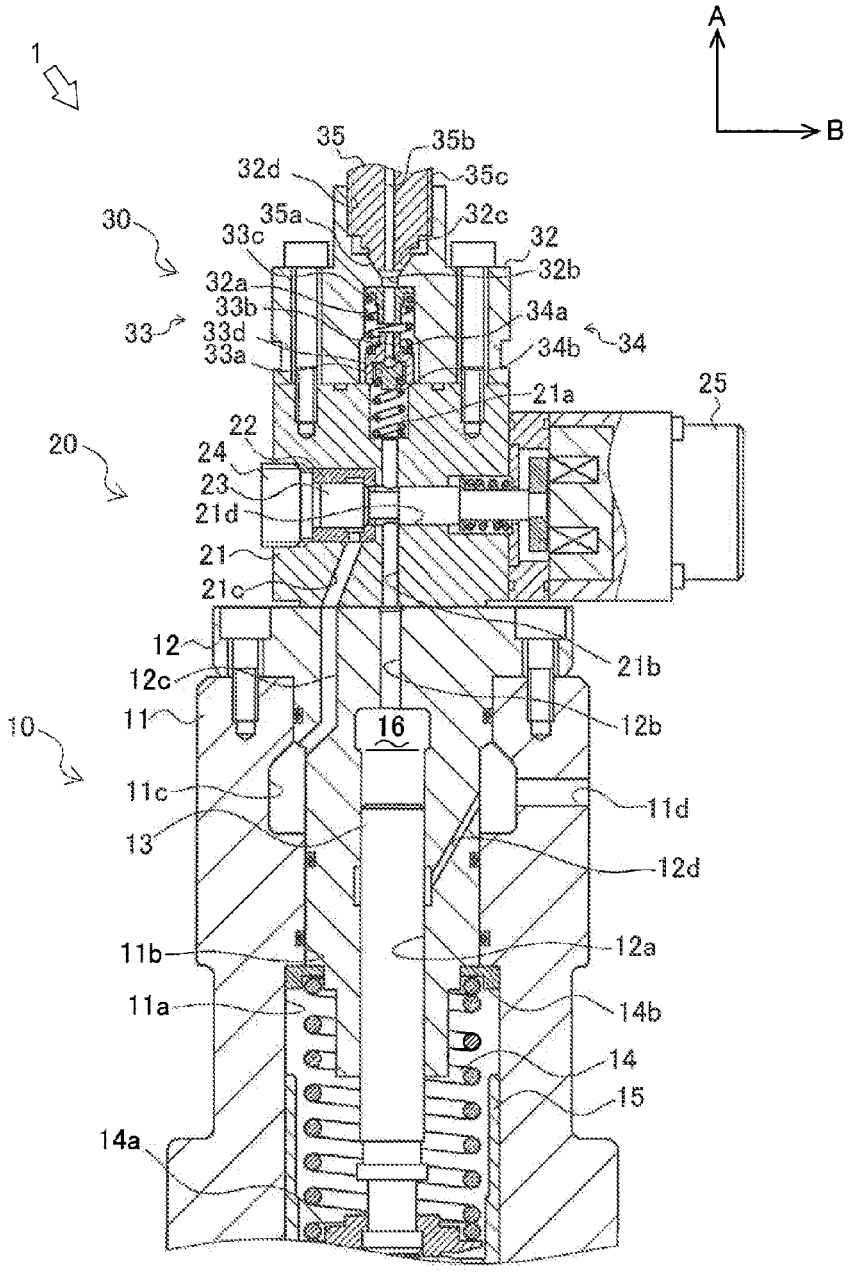
[FIG. 3] A sectional view of a part of another embodiment of the fuel injection pump according to the first embodiment of the present invention.

As shown in FIG. 3, the delivery valve 33 may alternatively be constructed so that the housing 21 is formed therein with only the two-way delivery valve spring chamber 21*a* and the delivery valve 33 is installed in the delivery valve spring chamber 32*a* formed in the two-way delivery valve body part 32 so as to form a space between the delivery valve 33 and the inner peripheral surface of the delivery valve spring chamber 32*a*.

The two-way delivery valve 34 opens and closes the two-way delivery valve passage 33*b*. The two-way delivery valve 34 includes a two-way delivery valve body 34*a* and a two-way delivery valve spring 34*b*. The two-way delivery valve body 34*a* includes a ball and a receiver. The receiver is installed in the two-way delivery valve chamber 33*d* so as to form a space between the receiver and the inner peripheral surface of the two-way delivery valve chamber 33*d*. The ball is arranged on the receiver so as t sit on the opening of the two-way delivery valve passage 33*b* opened in the upper surface of the two-way delivery valve chamber 33*d*. The two-way delivery valve body 34*a* touches the two-way delivery valve spring 34*b* installed in the two-way delivery valve spring chamber 21*a* at the lower end surface of the receiver and is biased upward by the two-way delivery valve spring 34*b*. Accordingly, the two-way delivery valve 34 cuts off the communication between the two-way delivery valve chamber 33*d* and the two-way delivery valve passage 33*b* by the two-way delivery valve body 34*a* with the biasing force of the two-way delivery valve spring 34*b*.

The high-pressure pipe joint 35 supplies high-pressure fuel to a fuel injection nozzle (not shown). At one of the sides (the side of the discharge outlet 32*b*) of the high-pressure pipe joint 35, a circular seal surface 35*a* is formed taperingly which is reduced its diameter continuously downward in the outer peripheral surface of the high-pressure pipe joint 35. The high-pressure pipe joint 35 is pushed and attached to the two-way delivery valve body part 32 so that the seal surface 35*a* adheres closely to the seal surface 32*c* of the two-way delivery valve body part 32. Inside the high-pressure pipe joint 35, a fuel supply passage 35*b* is formed. The fuel supply passage 35*b* is communicated with the discharge outlet 32*b*.

As shown in FIG. 3, a male screw part 35*c* formed at the one of the sides (the side of the discharge outlet 32*b*) of the high-pressure pipe joint 35 may alternatively be screwed into the female screw part 32*d* formed in the upper portion of the two-way delivery valve body part 32.

The fuel injection pump according to the present invention is a PF type fuel injection pump in which the engine has a tappet in the first embodiment, but not limited thereto. For example, the fuel injection pump according to the present invention may alternatively be a PF type fuel injection pump in which the fuel injection pump body part has a tappet in the first embodiment.

According to the construction, when the fuel injection pump 1 discharges fuel, the fuel from a low-pressure pump (not shown) is supplied via the fuel supply port 11*d* of the pump body 11 to the fuel supply and discharge chamber 11*c*. The fuel supplied to the fuel supply and discharge chamber 11*c* is supplied via the first spill oil discharge passage 12*c* of the barrel 12 to the pressure chamber 16. When the plunger 13 is slid vertically following the rotation of the cam (not shown), the pressurized fuel flows through the pressure chamber 16, the first fuel supply passage 12*b*, and the second fuel supply passage 21*b* of the housing 21 in this order, and is supplied to the two-way delivery valve spring chamber 21*a* of the housing 21. In this case, the solenoid 25 of the electromagnetic spill valve 20 is excited based on the signal from the control device (not shown).

Figure 4:
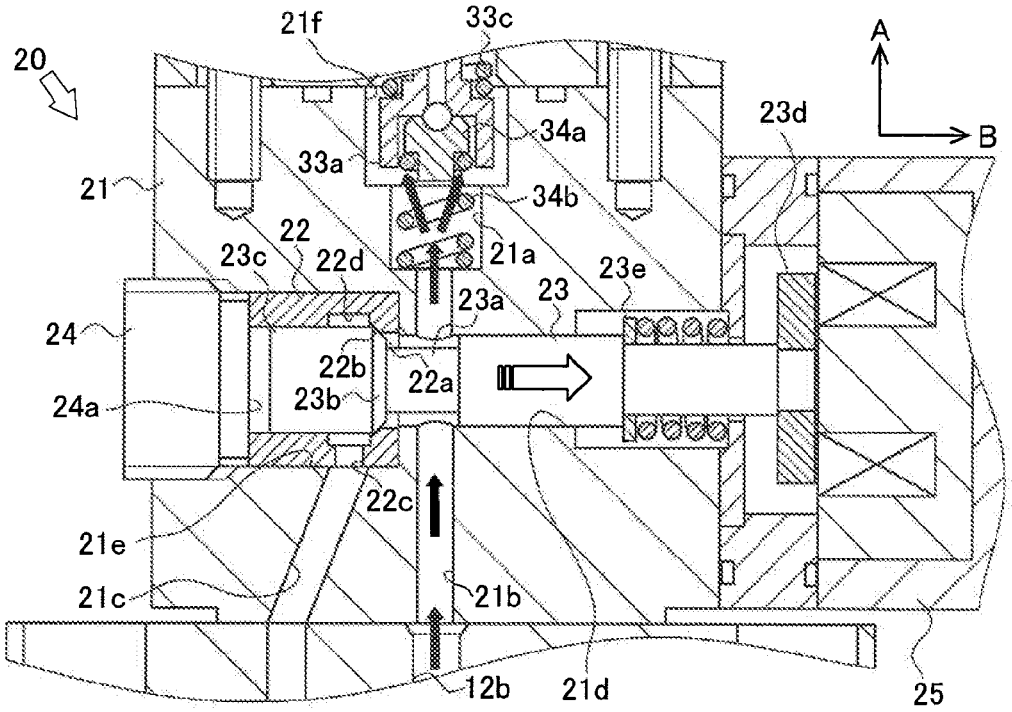
[FIG. 4] (*a*) is an enlarged sectional view of the electromagnetic spill valve showing the case of closing the electromagnetic spill valve. (*b*) is an enlarged sectional view of the electromagnetic spill valve showing the case of opening the electromagnetic spill valve.
Figure 4:
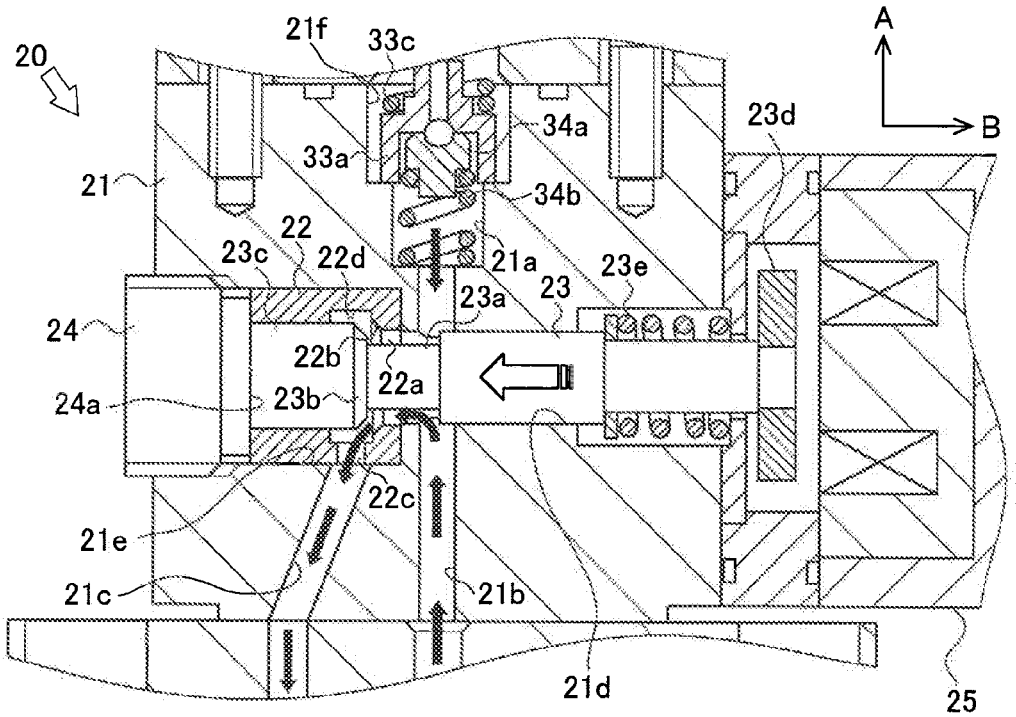

As shown in FIG. 4(*a*), in the electromagnetic spill valve 20, by the solenoid 25 magnetized based on the signal from the control device (not shown), the spill valve body 23 is slid rightward (along a direction of a white arrow). Then, the seal surface 23*b* of the spill valve body 23 sits on the valve seat 22*b* of the insert piece 22. As a result, the communication between the second fuel supply passage 21*b* and the second spill oil discharge passage 21*c* is cut off, and the fuel pressure in the second fuel supply passage 21*b* is not released via the second spill oil discharge passage 21*c* and is maintained. Therefore, the pressurized fuel flows along a direction of a black arrow and fills the pressure chamber 16 (see FIG. 1), the first fuel supply passage 12*b*, the second fuel supply passage 21*b* and the two-way delivery valve spring chamber 21*a*.

When the power applied on the delivery valve body 33*a* of the delivery valve 33 (the two-way delivery valve body 34*a* of the two-way delivery valve 34) by the fuel pressure in the two-way delivery valve spring chamber 21*a* becomes larger than the biasing force of the delivery valve spring 33*c* biasing downward the delivery valve body 33*a*, the delivery valve body 33*a* is moved upward and separated from the lower end surface of the delivery valve chamber 21*f*, whereby the delivery valve 33 is opened. In this case, the two-way delivery valve body 34*a* is opened. As a result, the pressurized fuel flows from the two-way delivery valve spring chamber 21*a* to the delivery valve spring chamber 32*a*, and is discharged from the delivery valve spring chamber 32*a* via the discharge outlet 32*b* to the fuel supply passage 35*b* of the high-pressure pipe joint 35 (see FIG. 1).

Accordingly, when the fuel pressure in the two-way delivery valve spring chamber 21*a* is released, by the biasing force of the delivery valve spring 33*c* biasing the delivery valve body 33*a* downward, the delivery valve body 33*a* is moved downward and sits on the lower end surface of the delivery valve chamber 21*f*, whereby the delivery valve 33 is closed. As a result, fuel is not discharged from the delivery valve spring chamber 32*a* via the discharge outlet 32*b* to the fuel supply passage 35*b*. In this case, pulsation is generated in fuel pressure which remains between the fuel supply passage 35*b* positioned downstream the delivery valve 33 and the fuel injection nozzle (not shown). When the power applied on the two-way delivery valve body 34*a* by the generated pulsation of fuel pressure is larger than the biasing force of the two-way delivery valve spring 34*b* biasing upward (toward the discharge outlet 32*b*) the two-way delivery valve body 34*a*, the two-way delivery valve body 34*a* is moved downward (oppositely to the discharge outlet 32*b*), whereby the two-way delivery valve 34 is opened. Accordingly, the fuel pressure increased by the pulsation is released and reduced to a predetermined value.

When the fuel injection pump 1 stops the discharge of fuel, as shown in FIG. 4(*b*), in the electromagnetic spill valve 20, by the solenoid 25 is demagnetized based on the signal from the control device (not shown). Accordingly, by the biasing force of the spill valve spring 23*e*, the spill valve body 23 is slid rightward (along a direction of a white arrow) until the spill valve body 23 touches the touching surface 24*a* of the stopper 24. Then, the seal surface 23*b* of the spill valve body 23 is separated from the valve seat 22*b* of the insert piece 22. Namely, the electromagnetic spill valve 20 is opened. As a result, the second fuel supply passage 21*b* and the second spill oil discharge passage 21*c* of the housing 21 are communicated with each other, and the fuel pressure in the second fuel supply passage 21*b* is released via the second spill oil discharge passage 21*c*. As a result, the fuel flows from the second fuel supply passage 21*b* through the spill valve hole 21*d*, the inside of the diameter enlarged part 22*d*, the spill oil discharge outlet 22*c* of the insert piece 22 and the second spill oil discharge passage 21*c* in this order along a direction of a black arrow, and is discharged via the first spill oil discharge passage 12*c* to the fuel supply and discharge chamber 11*c*.

Next, an explanation will be given on the mode in which the insert piece 22 and the spill valve body 23 are exchanged from the electromagnetic spill valve 20 and the mode in which the lift amount of the spill valve body 23 is controlled in the fuel injection pump 1 which is the first embodiment of the present invention referring to FIGS. 5 and 9.

Firstly, an explanation will be given on the mode in which the insert piece 22 and the spill valve body 23 are exchanged. As shown in FIG. 5(*a*), in the electromagnetic spill valve 20 of the fuel injection pump 1, the stopper 24 and the solenoid 25 are removed from the housing 21. Then, the armature 23*d* is removed from the spill valve body 23. By the work, the spill valve body 23 can be removed from the housing 21.

Figure 5:
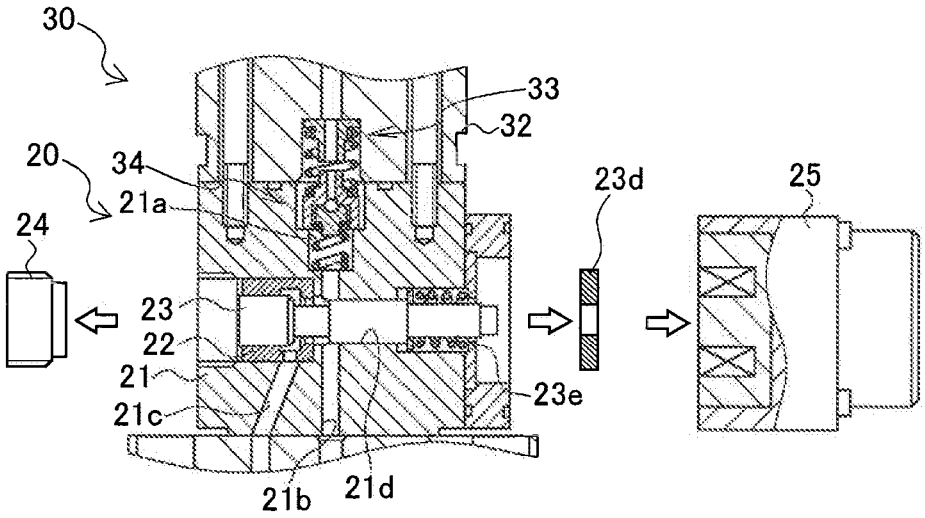
[FIG. 5] (*a*) is a sectional view of the mode of removing a spill valve body from the electromagnetic spill valve. (*b*) is a sectional view of the mode of removing an insert piece from the electromagnetic spill valve.
Figure 5:
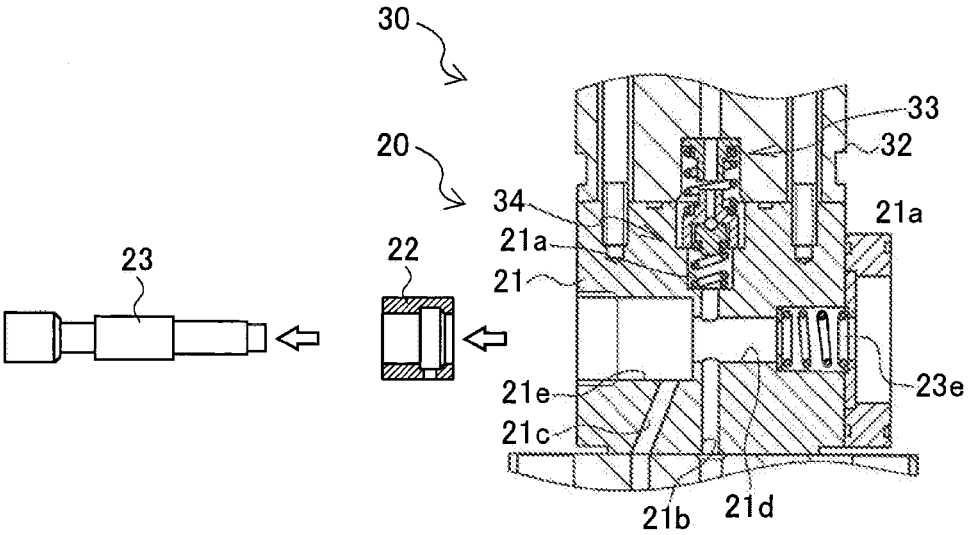

As shown in FIG. 5(*b*), by removing the spill valve body 23 from the housing 21, the insert piece 22 can be removed from the housing 21. Then, an insert piece and a spill valve body, which are replacement parts instead of the insert piece 22 and the spill valve body 23, and the armature 23*d*, the stopper 24 and the solenoid 25 removed priorly are attached to the housing 21 by the reverse processes. Accordingly, in the fuel injection pump 1, only the spill valve body 23 and the insert piece 22 of the electromagnetic spill valve 20 can be exchanged with new parts.

Figure 6:
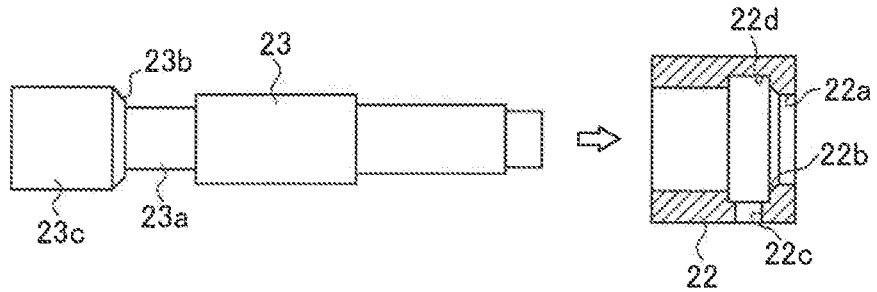
[FIG. 6] (*a*) is a partial sectional view of the mode of controlling lift amount of the spill valve body. (*b*) is a partial sectional view of the controlling part of the case of controlling the lift amount of the spill valve body.
Figure 6:
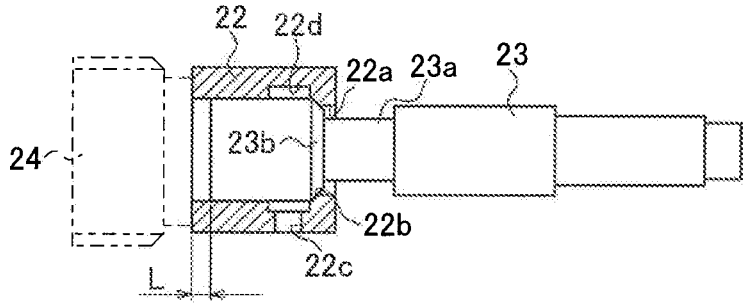

Next, an explanation will be given on the mode of control of the lift amount of the spill valve body 23. As shown in FIG. 6(*a*), the spill valve body 23 is inserted into the insert piece 22. In this case, the spill valve body 23 is installed in the insert piece 22 so that the seal surface 23*b* sits on the valve seat 22*b* of the insert piece 22. As shown in FIG. 6(*b*), the leftward sliding amount of the spill valve body 23 is controlled by the stopper 24 (the touching surface 24*a*) touching the left end surface of the insert piece 22. Namely, the lift amount of the spill valve body 23 is determined by a distance L between the left end of the insert piece 22 and the left end of the spill valve body 23 in the axial direction in the state in which the seal surface 23*b* sits on the valve seat 22*b* of the insert piece 22. Accordingly, the lift amount of the spill valve body 23 can be controlled by changing the distance L by the processing or exchange of the spill valve body or the insert piece.

Figure 7:
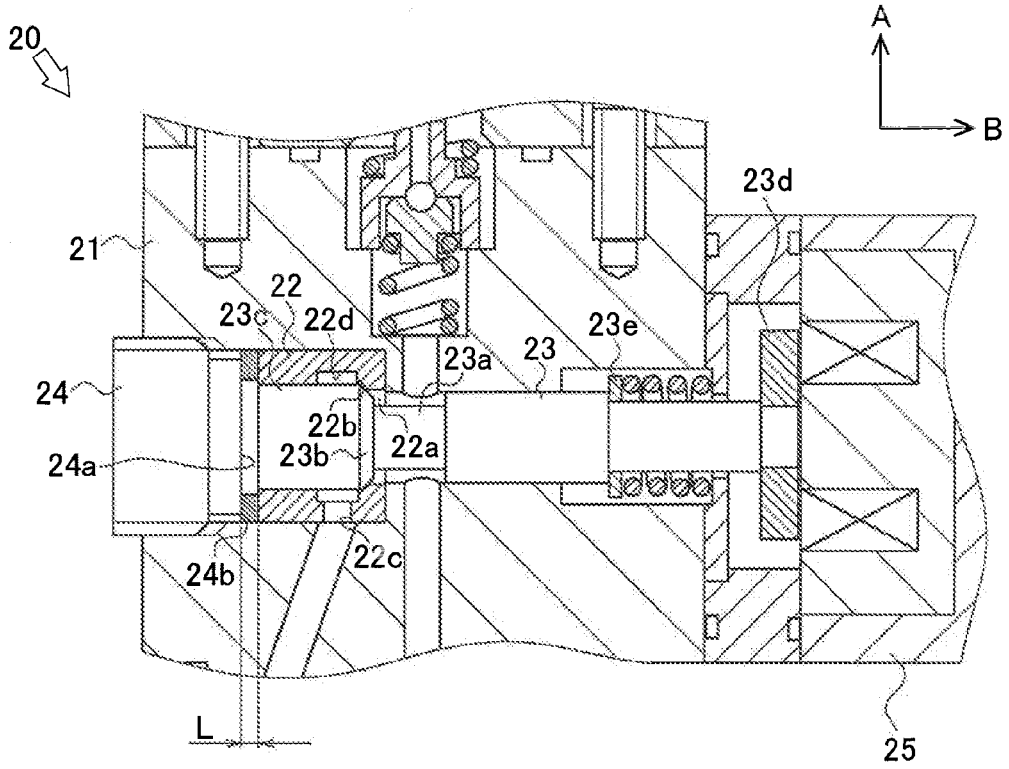
[FIG. 7] An enlarged sectional view of the controlling part of the case of controlling the lift amount of the spill valve body in another embodiment.

The distance L can also be changed by moving the attachment position of the stopper 24 in the axial direction (lateral direction). As shown in FIG. 7, the attachment position of the stopper 24 in the axial direction can be moved in the axial direction by interposing a shim 24*b* having optional width (width in the lateral direction) between the insert piece 22 and the stopper 24. Accordingly, the lift amount of the spill valve body 23 can be controlled by changing the attachment position of the stopper 24 in the axial direction by the thickness of the shim 24*b* so as to change the distance L.

As mentioned above, the fuel injection pump 1 which is the first embodiment of the present invention is the fuel injection pump 1 having the electromagnetic spill valve 20, and the electromagnetic spill valve 20 includes the housing 21 in which the insert piece insertion hole 21*e* is formed, the insert piece 22 formed to be substantially a cylinder whose inner peripheral surface has the valve seat 22*b* and detachably installed in the insert piece insertion hole 21*e* coaxially, the spill valve body 23 formed to be substantially a cylinder whose outer peripheral surface has the seal surface 23*b* facing the valve seat 22*b* and slidably inserted into the insert piece 22 so that the seal surface 23*b* sits on the valve seat 22*b* when the spill valve body 23 is slid rightward in the axial direction of the insert piece 22, the stopper 24 which is attached detachably to the housing 21 and can touch the spill valve body 23 when the spill valve body 23 is slid rightward in the axial direction of the insert piece 22, the solenoid 25 which can make the spill valve body 23 slid rightward in the axial direction, and the spill valve spring 23*e* which is a biasing member biasing the spill valve body 23 rightward in the axial direction.

According to the construction, in the fuel injection pump 1, when the valve seat 22*b* of the electromagnetic spill valve 20 is worn with the passage of time, what is necessary is just to exchange the spill valve body 23 and the insert piece 22 having the valve seat 22*b*. Namely, the components which need not be exchanged can be used continuously. Accordingly, the whole housing 21 of the electromagnetic spill valve 20 need not be constructed by material with high strength. In the electromagnetic spill valve 20, the insert piece 22 can be shaped simply so as to form the valve seat 22*b* in the insert piece 22 easily and accurately. As a result, when number of the parts increased, the characteristics of the fuel injection pump 1 can be maintained with the minimum maintenance cost without increasing the manufacturing cost.

The electromagnetic spill valve 20 is constructed so that the left end of the insert piece 22 touches the stopper 24 and the left end of the spill valve body 23 is separated from the stopper 24 when the seal surface 23*b* sits on the valve seat 22*b*.

According to the construction, in addition to the above-mentioned effect, at the time of opening the electromagnetic spill valve 20, the spill valve body 23 can be slid leftward in the axial direction of the insert piece 22 until the left end of the spill valve body 23 reaches the position the same as the left end of the insert piece 22. Namely, the lift amount of the spill valve body 23 at the time of opening the electromagnetic spill valve 20 is equal to the distance L between the left end of the spill valve body 23 and the left end of the insert piece 22 in the axial direction in the state in which the seal surface 23*b* of the spill valve body 23 has sit on the valve seat 22*b* of the insert piece 22, that is, at the time of opening the electromagnetic spill valve 20. Accordingly, in the electromagnetic spill valve 20, by only changing the positional relation between the left end of the spill valve body 23 and the left end of the insert piece 22, the lift amount of the spill valve body 23 can be controlled. As a result, the lift amount of the spill valve body 23 can be controlled easily and accurately, whereby the manufacturing cost and the maintenance cost can be reduced.

In the electromagnetic spill valve 20, the shim 24*b* is interposed between the left end of the insert piece 22 and the touching surface 24*a* of the stopper 24 so as to be exchangeable.

According to the construction, in the electromagnetic spill valve 20, the lift amount of the spill valve body 23 can be controlled by only changing the position of the touching surface 24*a* of the stopper 24 by exchanging the shim 24*b*. Accordingly, it is not necessary to have the plurality of the stopper 24 having different positions of the touching surface 24*a* as stock parts for the control. As a result, the cost of the stock parts for the control can be reduced, and the lift amount of the spill valve body 23 can be controlled easily and accurately, whereby the manufacturing cost and the maintenance cost can be reduced.

Figure 8:
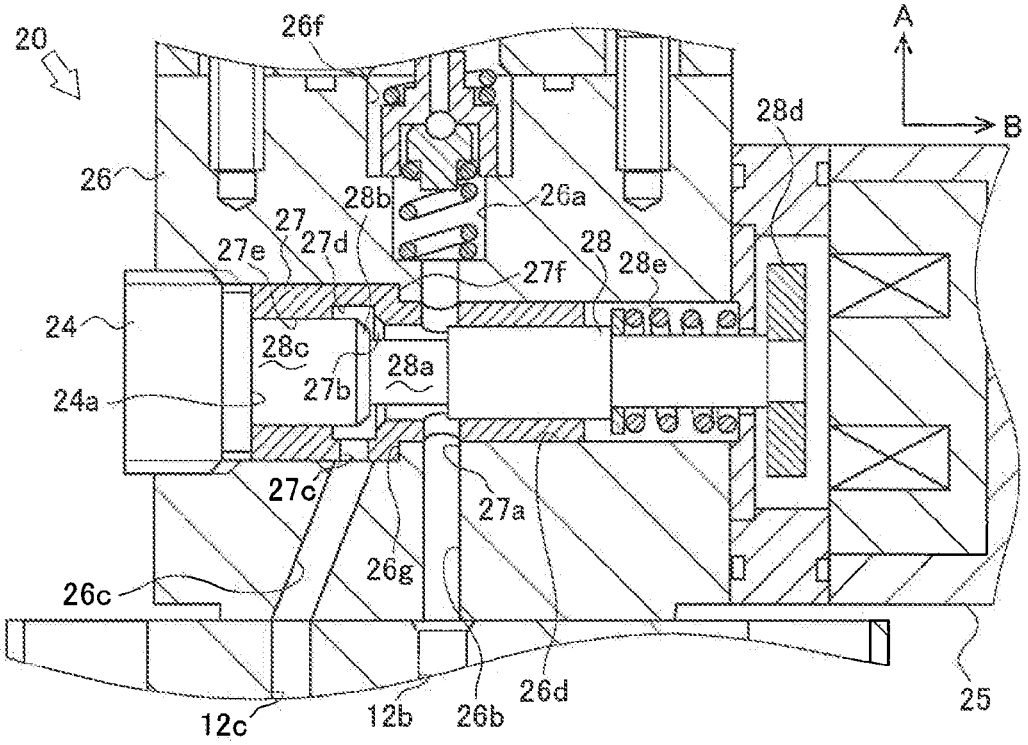
[FIG. 8] An enlarged sectional view of an electromagnetic spill valve of a fuel injection pump according to a second embodiment of the present invention.

An explanation will be given on a fuel injection pump 2 which is a second embodiment of the fuel injection pump according to the present invention referring to FIG. 8. In below embodiment, components the same as those of the first embodiment are designated by the same reference numerals and the concrete explanation thereof is omitted, and the different parts are described mainly.

The fuel injection pump 2 is connected to a low pressure pump (feed pump) (not shown), and fuel from the low pressure pump is pressurized in the fuel injection pump 2 and supplied to a fuel injection nozzle (not shown). The fuel injection pump 2 includes the pump body part 10, the electromagnetic spill valve 20 and the two-way delivery valve part 30 (see FIG. 1).

The electromagnetic spill valve 20 opens and closes the first spill oil discharge passage 12*c* and a second spill oil discharge passage 26*c* for releasing the fuel pressurized in the pressure chamber 16 to the fuel supply and discharge chamber 11*c* at the low pressure side so as to control the fuel injection of the fuel injection pump 2. The electromagnetic spill valve 20 has a housing 26, an insert piece 27, a spill valve body 28, the stopper 24, the solenoid 25 and the like.

The housing 26 is a structure constituting the body of the electromagnetic spill valve 20. The housing 26 is substantially rectangular. In the upper portion of the housing 26, a two-way delivery valve spring chamber 26*a* is formed so as to be extended vertically. A delivery valve chamber 26*f* is formed so as to be enlarged its diameter and extended upward from the middle portion of the two-way delivery valve spring chamber 26*a*. In the lower portion of the housing 26, a second fuel supply passage 26*b* is formed so as to be extended vertically. The two-way delivery valve spring chamber 26*a* is increased its diameter larger than that of the second fuel supply passage 26*b* and communicated with the second fuel supply passage 26*b*. In the middle portion in the vertical direction of the housing 26, an insert piece insertion hole 26*d* is formed so as to penetrate the housing 26 laterally. The insert piece insertion hole 26*d* crosses and is communicated with the second fuel supply passage 26*b*. Accordingly, the insert piece insertion hole 26*d* is communicated with the two-way delivery valve spring chamber 26*a* via the second fuel supply passage 26*b*. The insert piece insertion hole 26*d* is reduced its diameter at the side rightward from the middle portion thereof at the left of the second fuel supply passage 26*b* so as to form a stepped part 26*g*. A female screw part is formed at the left end of the insert piece insertion hole 26*d*.

In the part outside the second fuel supply passage 26*b* of the housing 26, a second spill oil discharge passage 26*c* is formed so as to be extended vertically. The second spill oil discharge passage 26*c* is communicated with the insert piece insertion hole 26*d*. The housing 26 is fixed to the barrel 12 by a bolt or the like while the lower end surface of the housing 26 adheres closely to the upper end surface of the barrel 12. In this case, the second fuel supply passage 26*b* is communicated with the first fuel supply passage 12*b* of the barrel 12, and the second spill oil discharge passage 26*c* is communicated with the first spill oil discharge passage 12*c* of the barrel 12.

The insert piece 27 is a member on which the spill valve body 28 sits. The insert piece 27 is formed to be a substantially cylinder whose length is shorter than that of the insert piece insertion hole 26*d*. The insert piece 27 is reduced its diameter from the middle portion thereof so as to form a stepped part 27*f*. The insert piece 27 is inserted into the insert piece insertion hole 26*d* closely and detachably so that the stepped part 27*f* touches the stepped part 26*g* of the insert piece insertion hole 26*d*, and the left end of the insert piece 27 is biased by the stopper 24. At the part of the insert piece 27 crossing the second fuel supply passage 26*b* when the insert piece 27 is inserted into the insert piece insertion hole 26*d*, a fuel supply hole 27*a* is formed penetratingly.

Figure 9:
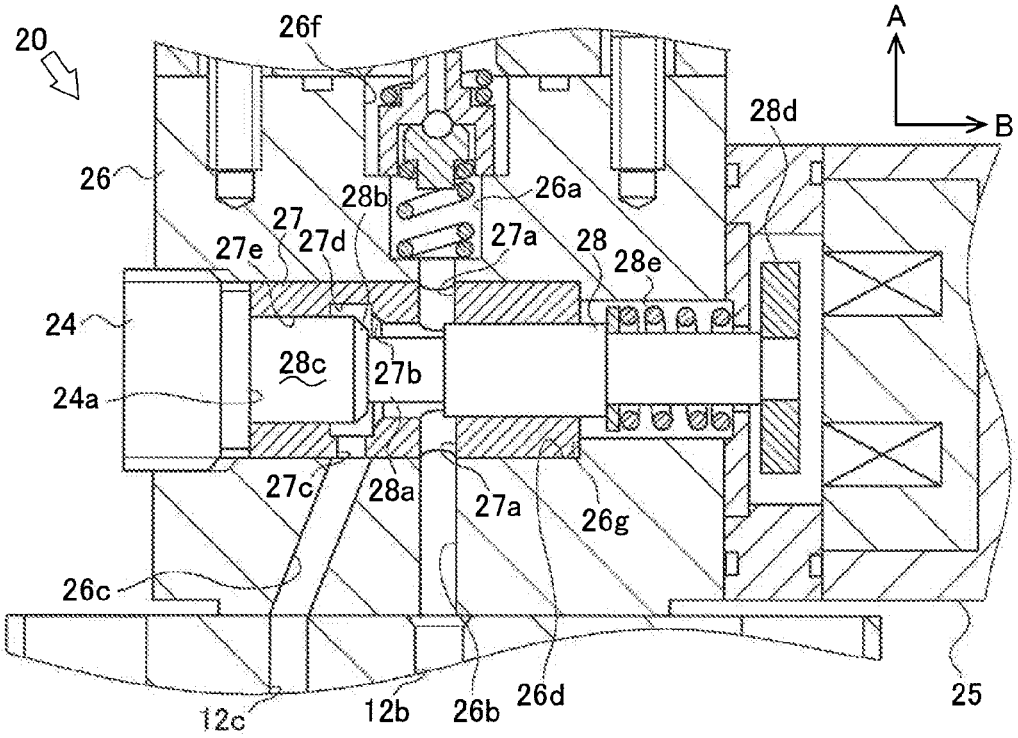
[FIG. 9] An enlarged sectional view of an electromagnetic spill valve of another embodiment of the fuel injection pump according to the second embodiment of the present invention.

As shown in FIG. 9, it may alternatively constructed so that the diameter of the right end of the insert piece insertion hole 26*d* is reduced so as to form the stepped part 26*g* and the insert piece 27 is inserted into the insert piece insertion hole 26*d* closely and detachably so as to make the right end of the insert piece 27 touch the stepped part 26*g* and the left end of the insert piece 27 is biased by the stopper 24.

In the insert piece 27, the inner diameter thereof is expanded leftward from the fuel supply hole 27*a* so as to form a first diameter enlarged part 27*d*. The insert piece 27 has a valve seat 27*b* which is formed taperingly so as to increase its diameter leftward continuously in the inner peripheral surface of the insert piece 27. Furthermore, in the insert piece 27, a second diameter enlarged part 27*e* whose inner diameter is reduced at the left of the first diameter enlarged part 27*d*. The inner diameter of the first diameter enlarged part 27*d* is formed larger than that of the second diameter enlarged part 27*e*. In the insert piece 27, a spill oil discharge outlet 27*c* is formed so that the first diameter enlarged part 27*d* is communicated with the second spill oil discharge passage 26*c* of the housing 26. The insert piece 27 is installed in the insert piece insertion hole 26*d*.

The spill valve body 28 switches the flow path of fuel pressingly sent in the second fuel supply passage 26*b*. The spill valve body 28 is slidably inserted into the insert piece 27, in the part of the spill valve body 28 crossing the fuel supply hole 27*a* of the insert piece 27 when the spill valve body 28 is inserted into the insert piece 27, a diameter reduced part 28*a* whose diameter is smaller than that of the spill valve body 28 is provided. Accordingly, the spill valve body 28 does not block the flow of fuel in the second fuel supply passage 26*b* over the insert. At the left end of the diameter reduced part 28*a*, the spill valve body 28 has a seal surface 28*b* formed taperingly so that its diameter is enlarged leftward in the outer peripheral surface of the insert piece 27. The seal surface 28*b* is formed so as to be able to sit closely on the valve seat 27*b* of the insert piece 27.

The spill valve body 28 has a diameter enlarged part 28*c* whose diameter is enlarged the same as the inner diameter of the second diameter enlarged part 27*e* of the insert piece 27 from the left end surface of the spill valve body 28 to the seal surface 28*b*. The part of the spill valve body 28 rightward from the diameter reduced part 28*a* is slidably inserted into the insert piece 27, and the diameter enlarged part 28*c* at the part leftward from the seal surface 28*b* is slidably inserted into the second diameter enlarged part 27*e* of the insert piece 27. Namely, more than the half of the spill valve body 28 in the length in the axial direction is inserted to only the insert piece 27 installed in the housing 26, and the spill valve body 28 is guided by only the insert piece 27 when the spill valve body 28 is slid.

When the spill valve body 28 is slid rightward, the seal surface 28*b* sits on the valve seat 27*b* of the insert piece 27. In this case, the left end of the spill valve body 28 is positioned at the right of the left end of the insert piece 27. The spill valve body 28 is biased leftward by the spill valve spring 28*e* installed in the diameter enlarged part at the right end of the insert piece insertion hole 26*d*. At the right end of the spill valve body 28, an armature 28*d* constructed by a magnetic substance is disposed.

As mentioned above, in the electromagnetic spill valve 20, the spill valve body 28 is supported by only the insert piece 27.

According to the construction, the spill valve body 28 is guided by only the insert piece 27 installed, in the housing 26. Accordingly, in the electromagnetic spill valve 20, the spill valve body 28 can be installed accurately. As a result, the sitting accuracy of the valve seat 27*b* of the insert piece 27 and the seal surface 28*b* of the spill valve body 28 can be improved so as to suppress the amount of abrasion, whereby the maintenance cost can be reduced.

The invention claimed is:

1. A fuel injection pump having an electromagnetic spill valve, wherein the electromagnetic spill valve comprises:

a housing in which an insert piece insertion hole is formed;

an insert piece formed to be substantially a cylinder whose inner peripheral surface has a valve seat and detachably installed in the insert piece insertion hole coaxially;

a spill valve body formed to be substantially a cylinder whose outer peripheral surface has a seal surface facing the valve seat and slidably inserted into the insert piece so that the seal surface can sit on the valve seat when the spill valve body is slid toward a first side of the electromagnetic spill valve in an axial direction of the insert piece;

a stopper which is attached detachably to the insert piece insertion hole and configured to touch the spill valve body when the spill valve body is slid toward a second side of the electromagnetic spill valve in the axial direction of the insert piece;

a solenoid configured to slide the spill valve body toward the first side; and a biasing member biasing the spill valve body toward the second side, wherein the stopper touches the insert piece and fixes the insert piece within the insert piece insertion hole, and wherein an end of the spill valve body is separated from the stopper when the seal surface abuts the valve seat.

2. The fuel injection pump according to claim 1, wherein, in the electromagnetic spill valve, the spill valve body is supported by only the insert piece.

3. The fuel injection pump according to claim 1, wherein, in the electromagnetic spill valve, a variable thickness shim is interposed between the insert piece and the stopper.

* * * * *